US009267286B2

(12) United States Patent
Kim

(10) Patent No.: US 9,267,286 B2
(45) Date of Patent: Feb. 23, 2016

(54) HOLLOW STRUCTURE, AND PREPARATION METHOD THEREOF

(71) Applicant: AJOU UNIVERSITY INDUSTRY-ACADEMIC COOPERATION FOUNDATION, Gyeonggi-do (KR)

(72) Inventor: Jang Hoon Kim, Suwon-si (KR)

(73) Assignee: AJOU UNIVERSITY INDUSTRY-ACADEMIC COOPERATION FOUNDATION, Gyeonggi-Do (KR)

( * ) Notice: Subject to any disclaimer, the term of this patent is extended or adjusted under 35 U.S.C. 154(b) by 0 days.

(21) Appl. No.: 14/404,638

(22) PCT Filed: Oct. 29, 2012

(86) PCT No.: PCT/KR2012/008920
§ 371 (c)(1),
(2) Date: Dec. 1, 2014

(87) PCT Pub. No.: WO2013/180347
PCT Pub. Date: Dec. 5, 2013

(65) Prior Publication Data

US 2015/0113913 A1 Apr. 30, 2015

(30) Foreign Application Priority Data

May 29, 2012 (KR) ..... 10-2012-0056758

(51) Int. Cl.

| | |
|---|---|
| ***E04C 3/00*** | (2006.01) |
| ***E04C 3/34*** | (2006.01) |
| ***E04C 5/07*** | (2006.01) |
| ***E04C 5/06*** | (2006.01) |
| ***E04C 5/20*** | (2006.01) |
| ***E04B 1/22*** | (2006.01) |
| ***E04C 3/36*** | (2006.01) |
| ***E04C 5/08*** | (2006.01) |

(Continued)

(52) U.S. Cl.
CPC . *E04C 3/34* (2013.01); *B28B 21/56* (2013.01); *B28B 21/82* (2013.01); *E04B 1/22* (2013.01); *E04C 3/36* (2013.01); *E04C 5/0604* (2013.01); *E04C 5/07* (2013.01); *E04C 5/08* (2013.01); *E04C 5/208* (2013.01); *E04B 2103/02* (2013.01)

(58) Field of Classification Search
CPC ..... E04G 23/0218; E04G 3/34; E04G 21/12
USPC ..... 52/834, 831, 687, 848
See application file for complete search history.

(56) References Cited

U.S. PATENT DOCUMENTS 1,709,893 A * 4/1929 Bemis ..... 138/141
3,987,593 A * 10/1976 Svensson ..... 52/98

(Continued)

FOREIGN PATENT DOCUMENTS

JP 2000-064505 2/2000
KR 10-2005-0020245 A 3/2005

(Continued)

*Primary Examiner* — Basil Katcheves
(74) *Attorney, Agent, or Firm* — Revolution IP, PLLC

(57) ABSTRACT

A hollow-core structure including: an inner mold that has a hollow cylindrical shell shape; an outer mold that has a hollow cylindrical shell shape to correspond to the inner mold, and in which the inner mold is disposed to be separated; and a filling member that is filled in a separation space between the inner mold and the outer mold.

13 Claims, 19 Drawing Sheets

(51) Int. Cl.
*B28B 21/56* (2006.01)
*B28B 21/82* (2006.01)

(56) References Cited

U.S. PATENT DOCUMENTS 4,018,055 A * 4/1977 Le Clercq ..... 405/257
4,166,347 A * 9/1979 Pohlman et al. ..... 52/223.4
4,242,851 A * 1/1981 Pohlman et al. ..... 52/848
5,050,356 A * 9/1991 Johnson et al. ..... 52/295
5,675,956 A * 10/1997 Nevin ..... 52/848
6,123,485 A * 9/2000 Mirmiran et al. ..... 405/252
6,295,782 B1 * 10/2001 Fyfe ..... 52/834
6,322,863 B1 * 11/2001 Kubicky ..... 428/34.5
6,409,433 B1 * 6/2002 Hubbell et al. ..... 405/250
6,453,636 B1 * 9/2002 Ritz ..... 52/835
6,519,909 B1 * 2/2003 Fawley ..... 52/834
6,705,058 B1 * 3/2004 Foust et al. ..... 52/296
8,104,242 B1 * 1/2012 Fouad et al. ..... 52/223.4
8,713,891 B2 * 5/2014 Carr et al. ..... 52/745.17

FOREIGN PATENT DOCUMENTS

KR 10 0860591 B1 9/2008
KR 10-0864953 B1 10/2008
KR 10-0862005 31 4/2010
KR 10-2011-0103000 A 9/2011
KR 10-1076581 B1 10/2011

* cited by examiner

FIG. 12
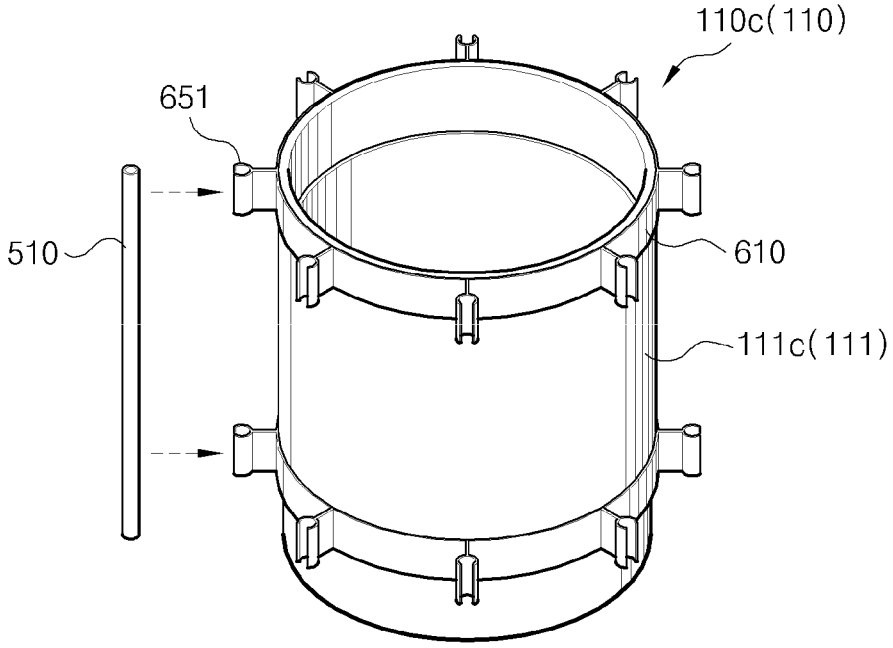
[FIG. 13]
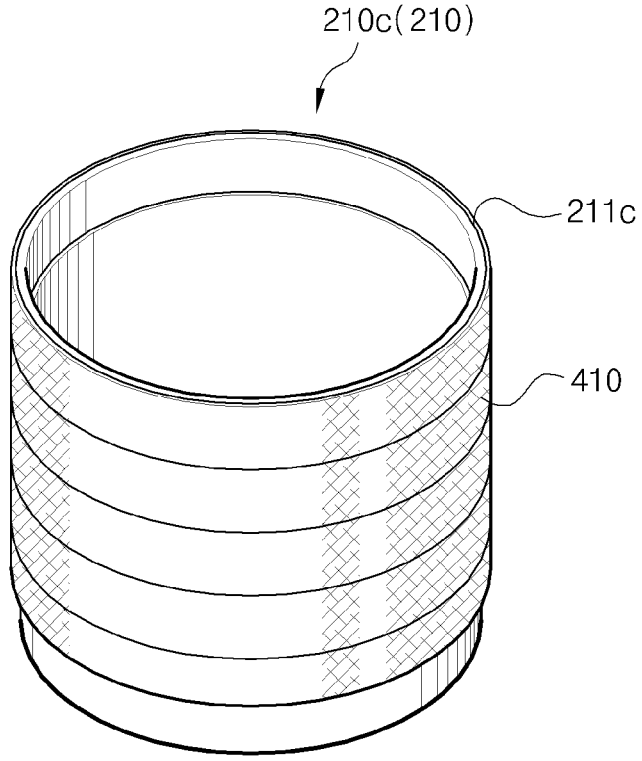

HOLLOW STRUCTURE, AND PREPARATION METHOD THEREOF

CROSS REFERENCE TO PRIOR APPLICATIONS

This application is a National Stage Application of PCT International Patent Application No. PCT/KR2012/008920 filed on Oct. 29, 2012, under 35 U.S.C. §371, which claims priority to Korean Patent Application No. 10-2012-0056758 filed on May 29, 2012, which are all hereby incorporated by reference in their entirety.

BACKGROUND

The present invention relates to a hollow-core structure and a method of manufacturing the same, and more particularly, to a hollow-core structure and a method of manufacturing the same capable of having sufficient structural stiffness and strength while reducing the total weight by forming an inner hollow portion.

In general, when a concrete column on which a large compressive load and bending act has insufficient lateral confinement or has a tall and narrow shape, such concrete column is destroyed at strength lower than that expected from a material. According to a traditional design method, in order to avoid such premature failure, it is necessary to unnecessarily increase a cross-section area of the column in a large-scaled structure such as a high-rise building or a high-rise tower, and, thus, a large and heavy column that is difficult to treat may be constructed.

Since a process of providing a formwork, a process of casting concrete, and a process of removing the formwork are performed, it takes a lot of time to construct the concrete column according to the related art and it is also costly to construct the concrete column. Thus, there is a problem in that it is difficult to reduce construction cost.

As an alternative of the concrete structure according to the related art described above, a steel structure may be used. However, above-mentioned limitations are not likely to be largely improved due to buckling, and in addition to this, steel structures are vulnerable to corrosion.

SUMMARY OF THE INVENTION

The present invention has been made in an effort to provide a hollow-core structure with an improved structural property and a method of manufacturing the same with which it is easy to handle and manufacture by reducing the total weight due to formation of an inner hollow portion, it is possible to secure safety against buckling and compressive strength by suppressing a premature failure condition, and it is possible to secure economic feasibility by omitting attachment and detachment processes of the formwork.

According to an aspect of the present invention, there is provided a hollow-core structure including: an inner mold that has a hollow cylindrical shell shape; an outer mold that has a hollow cylindrical shell shape to correspond to the inner mold, and in which the inner mold is disposed to be separated; and a filling member that is filled in a separation space between the inner mold and the outer mold.

The hollow-core structure may further include a confinement unit that is provided to surround an outer peripheral surface of the outer mold and confines the outer mold. Here, the confinement unit may be preferably made of a carbon fiber reinforced polymer (CFRP) or an equivalently tough material that is wound the outer peripheral surface of the outer mold by a plurality of turns.

The hollow-core structure may further include: a plurality of ducts that is arranged radially in the longitudinal direction of the inner mold to be separated from an outer peripheral surface of the inner mold; and a plurality of prestressing tendons that is inserted into the ducts to be arranged radially between the inner mold and the outer mold, and is tensioned. Here, the hollow-core structure may further include a duct fixing unit that is coupled to surround the outer peripheral surface of the inner mold and is provided with a plurality of holders capable of detachably coupling the ducts to correspond to the plurality of ducts.

Meanwhile, the inner mold may include a plurality of individual inner mold that is divided to be layered, and the outer mold may include a plurality of individual outer molds that is divided to be layered to respectively correspond to the plurality of individual inner mold. In this case, the individual outer molds that are divided to be layered may be confined by a plurality of individual confinement units that is provided to independently surround outer peripheral surfaces of the individual outer molds. Here, the plurality of individual confinement units may be preferably made of a carbon fiber reinforced polymer (CFRP) or an equivalently tough material that is wound around outer surfaces of the individual outer molds by a plurality of turns. Meanwhile, the inner mold and the outer mold may be molded using a plastic material.

The individual inner molds and the individual outer molds that are divided to be layered and are vertically adjacent to each other may be coupled in a female and male coupling manner. For example, the individual inner molds that are divided to be layered and are vertically adjacent to each other and the individual outer molds that are vertically adjacent to each other may be screwed, or may be slidably coupled.

The filling member may include a plurality of individual filling members that is divided to be layered to correspond to the individual inner molds and the individual outer molds that are divided to be layered. In this case, the filling member may further include a plurality of non-shrink high-strength mortar layers that is filled between the individual filling members that are divided to be layered, and is coupled to each other such that stresses on contact surfaces between the individual filling members that vertically come in contact with each other are uniformly distributed. Further, shear keys may be interposed at lower ends of the individual filling members that are divided to be layered to reinforce the coupling between the individual filling members that vertically come in contact with each other. The filling member may be concrete. Reinforcement steel or a reinforcing material including reinforcing fiber may be embedded into the concrete when necessary. Here, a plurality of individual ducts may be arranged radially to be separated from outer peripheral surfaces of the individual inner molds, and may be provided in the longitudinal direction of the individual inner mold to allow prestressing tendons to be inserted. In this case, individual duct fixing units may be coupled to surround the outer peripheral surfaces of the individual inner molds, and may be provided with a plurality of individual holders capable of detachably coupling the individual ducts to correspond to the individual ducts.

The inner mold and the outer mold may be arranged so that the filling member has a uniform thickness. Alternatively, the inner mold and the outer mold may be arranged so that the thickness of the filling member linearly varies in the longitudinal direction. Otherwise, the inner mold and the outer mold may be arranged so that the thickness of the filling member in the longitudinal direction. Alternatively, the inner mold and the outer mold may be arranged so that the thickness of the filling member is in its maximum at the central portion in the longitudinal direction, or increases toward the lower side in the longitudinal direction.

According to another aspect of the present invention, there is provided a method of manufacturing a hollow structure including: preparing an inner mold having a hollow cylindrical shell shape; preparing an outer mold that has a hollow cylindrical shell shape to correspond to the inner mold, and into which the inner mold is inserted to be separated; arranging the inner mold and the outer mold by inserting the inner mold into the outer mold to be separated; and filling a fluidity filling material in a separation space between the inner mold and the outer mold, and curing the filling material.

Here, the preparation of the outer mold may further include providing a confinement unit that is provided to surround an outer peripheral surface of the outer mold to confine the outer mold. As the confinement unit, a carbon fiber reinforced polymer (CFRP) material that is wound around the outer peripheral surface of the outer mold by a plurality of turns may be preferably used.

Meanwhile, the preparation of the inner mold may include preparing a plurality of individual inner molds, and coupling the plurality of individual inner molds to each other, and layering the individual inner molds. Here, the individual inner molds may be preferably coupled in a female and male coupling manner. For example, the individual inner molds may be screwed, or may be slidably coupled.

The preparation of the outer mold may include preparing a plurality of individual outer molds, and coupling the plurality of individual outer molds to each other, and layering the individual outer molds. In this case, the individual outer molds that are divided to be layered and are vertically adjacent to each other may be preferably coupled to each other in a female and male coupling manner. For example, the individual outer molds may be screwed, or may be slidably coupled to each other. Here, the preparation of the plurality of individual outer molds may further include providing a plurality of individual confinement units that independently surrounds outer peripheral surfaces of the individual outer molds to independently confine the individual outer molds. Here, the plurality of individual confinement units may be preferably made of a carbon fiber reinforced polymer (CFRP) material that is wound around the outer peripheral surfaces of the individual outer molds by a plurality of turns.

After preparing the inner mold, the method of manufacturing a hollow-core structure may further include: coupling a duct fixing unit provided with a plurality of holders that is arranged radially to be separated from an outer peripheral surface of the inner mold to the outer peripheral surface of the inner mold, and detachably coupling a plurality of ducts into which prestressing tendons are inserted to the holders. Here, after arranging the inner mold and the outer mold, the method of manufacturing a hollow-core structure may further include inserting the prestressing tendons into the ducts. Further, the method of manufacturing a hollow-core structure may further include tensioning the prestressing tendons after the filling and curing of the filling materials.

According to still another aspect of the present invention, there is provided a method of manufacturing a hollow-core structure, including; preparing a plurality of individual inner molds having a hollow cylindrical shell shape; preparing a plurality of individual outer molds that has a hollow cylindrical shell shape to correspond to the individual inner molds, and into which the individual inner molds are inserted to be separated; arranging the individual inner molds and the individual outer molds by inserting the individual inner molds into the individual outer molds to be separated; filling fluidity individual filling materials in separation spaces between the individual inner molds and the individual outer molds, and curing the individual filling materials; finishing a plurality of individual hollow-core structures by repeating the arranging of the individual inner molds and the individual outer molds and the filling and curing of the individual filling materials; and layering the plurality of individual hollow-core structures in a vertical direction.

Here, preparing the plurality of individual outer molds may further include providing individual confinement units that surrounds outer peripheral surfaces of the individual outer molds to confine the individual outer molds. Here, the confinement unit may be preferably made of a carbon fiber reinforced polymer (CFRP) material that is wound around the outer peripheral surface of the individual outer mold by a plurality of turns.

In the layering the plurality of individual hollow-core structures, non-shrink and high-strength mortars may be preferably filled between the individual filling members that are vertically adjacent to each other to couple the individual filling members to each other such that stresses on contact surfaces are uniformly distributed.

After preparing the individual inner molds, the method of manufacturing a hollow-core structure may further include coupling individual duct fixing units provided with a plurality of individual holders that is arranged in a ring shape to be separated from the outer peripheral surfaces of the individual inner molds to the outer peripheral surfaces of the individual inner molds, and detachably coupling a plurality of individual ducts into which prestressing tendons are inserted to the individual holders.

After the plurality of individual hollow-core structures is layered, in the layering of the plurality of individual hollow-core structures, the plurality of individual ducts may be vertically aligned in parallel.

After layering the plurality of individual hollow-core structures, the method of manufacturing a hollow-core structure may further include inserting prestressing tendons into the plurality of individual ducts. Furthermore, after inserting the prestressing tendons, the method of manufacturing a hollow structure may further include tensioning the prestressing tendons.

According to the hollow-core structure asper the present invention and the manufacturing method thereof, the following effects are expected.

Firstly, since an inner hollow portion is formed in the structure, the hollow-core structure can be variously applied as in the case where an intermediate structure such as a floor or an inner ladder of a wind-power plant towers is provided. Moreover, it is possible to reduce the total weight, and it is possible to reduce delivery cost.

Secondly, since the outer peripheral surface of the outer mold is inherently confined by the confinement unit such as a carbon fiber reinforced polymer (CFRP) material, it is possible to maximize compressive resistance, and it is possible to secure safety against a probable local buckling.

Thirdly, it is possible to apply the hollow-core structure to a precast concrete structure as well as cast-in-place concrete. Compared to the steel structure, the hollow-core structure can be easily manufactured, and can have economical advantages.

Fourthly, since the inner mold and the outer mold are respectively divided into a plurality of molds to manufacture and the manufactured molds can be detachably coupled to expand, it is possible to manufacture and transfer the hollow-core structure, and it is possible to systemize the hollow-core structure for mass production.

BRIEF DESCRIPTION OF THE DRAWINGS

FIG. 12 is a perspective view illustrating an inner mold illustrated in FIG. 11.

FIG. 13 is a perspective view illustrating an outer mold illustrated in FIG. 11.

DETAILED DESCRIPTION

Hereinafter, a preferred embodiments of the present invention will be described in detail with reference to the accompanying drawings.

Figure 1:
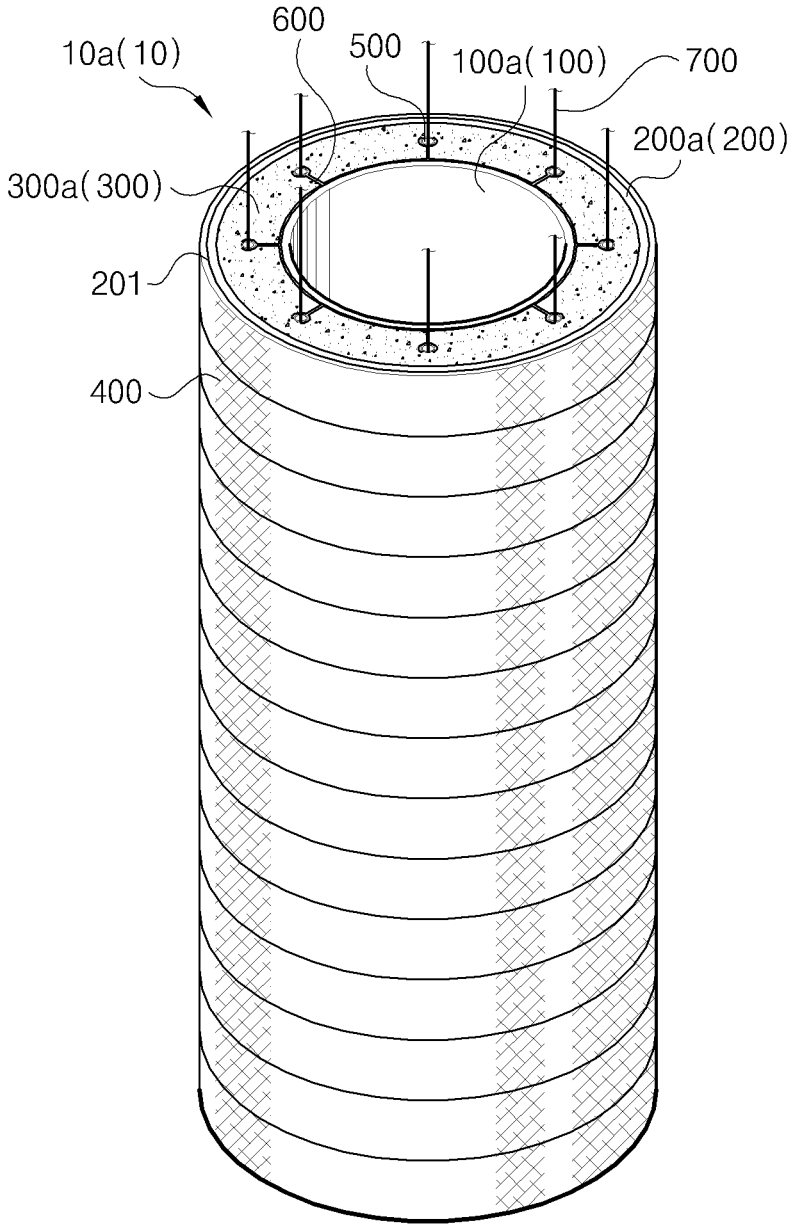
FIG. 1 is a perspective view illustrating a hollow-core structure asper a first embodiment of the present invention.
Figure 2:
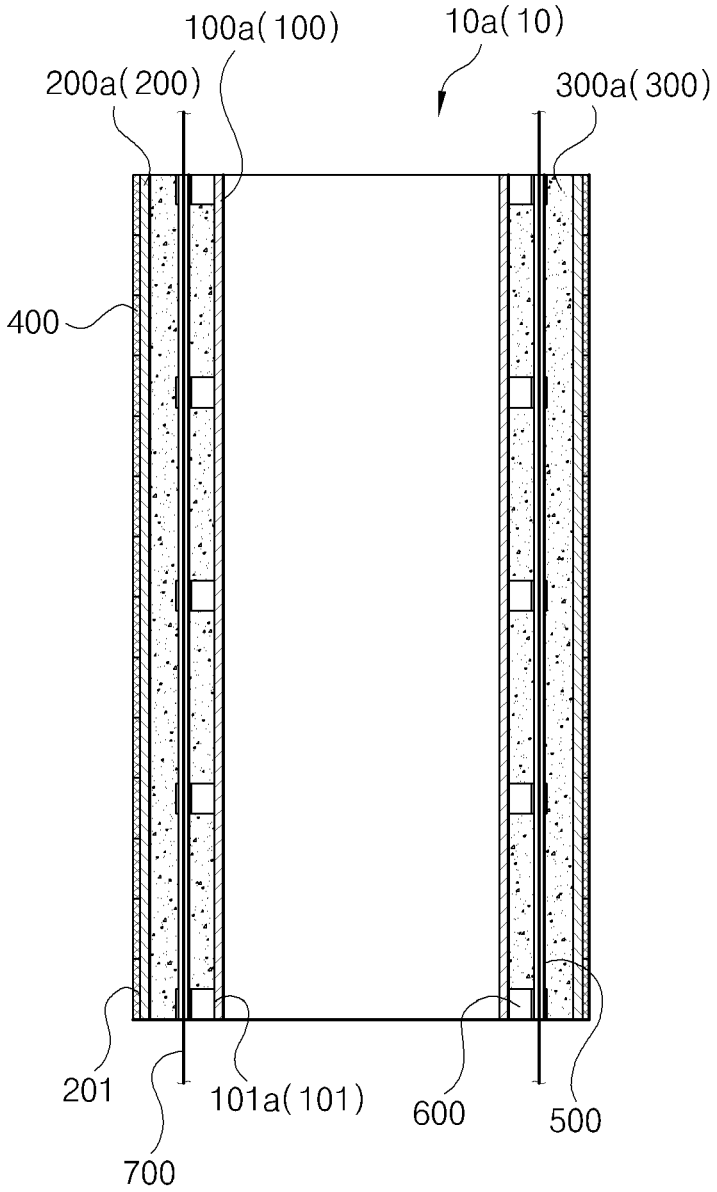
FIG. 2 is a longitudinal cross-sectional view of the hollow-core structure illustrated in FIG. 1.
Figure 3:
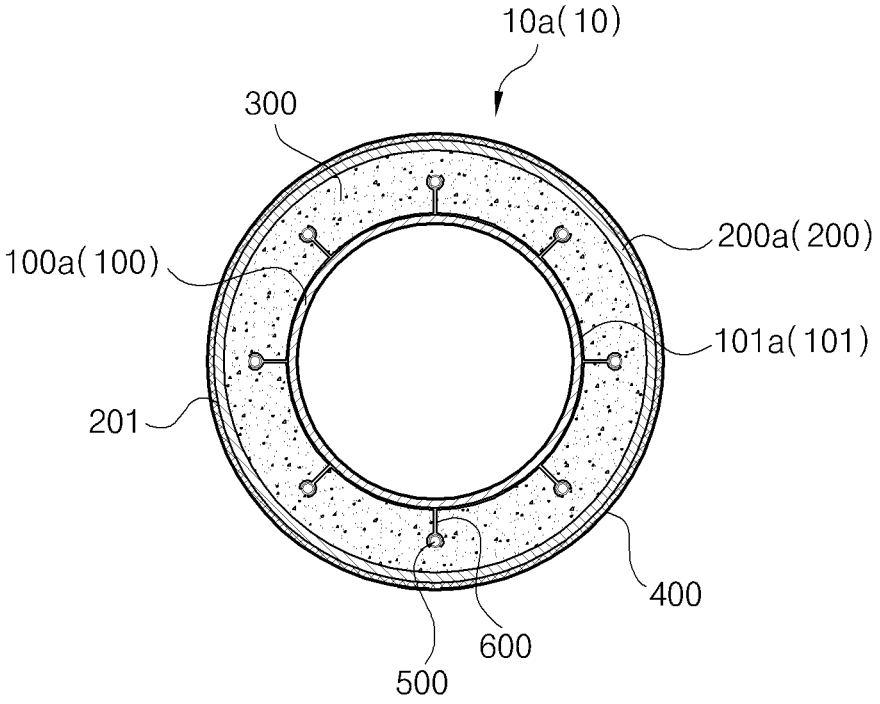
FIG. 3 is a plan cross-sectional view of the hollow-core structure illustrated in FIG. 1.
Figure 4:
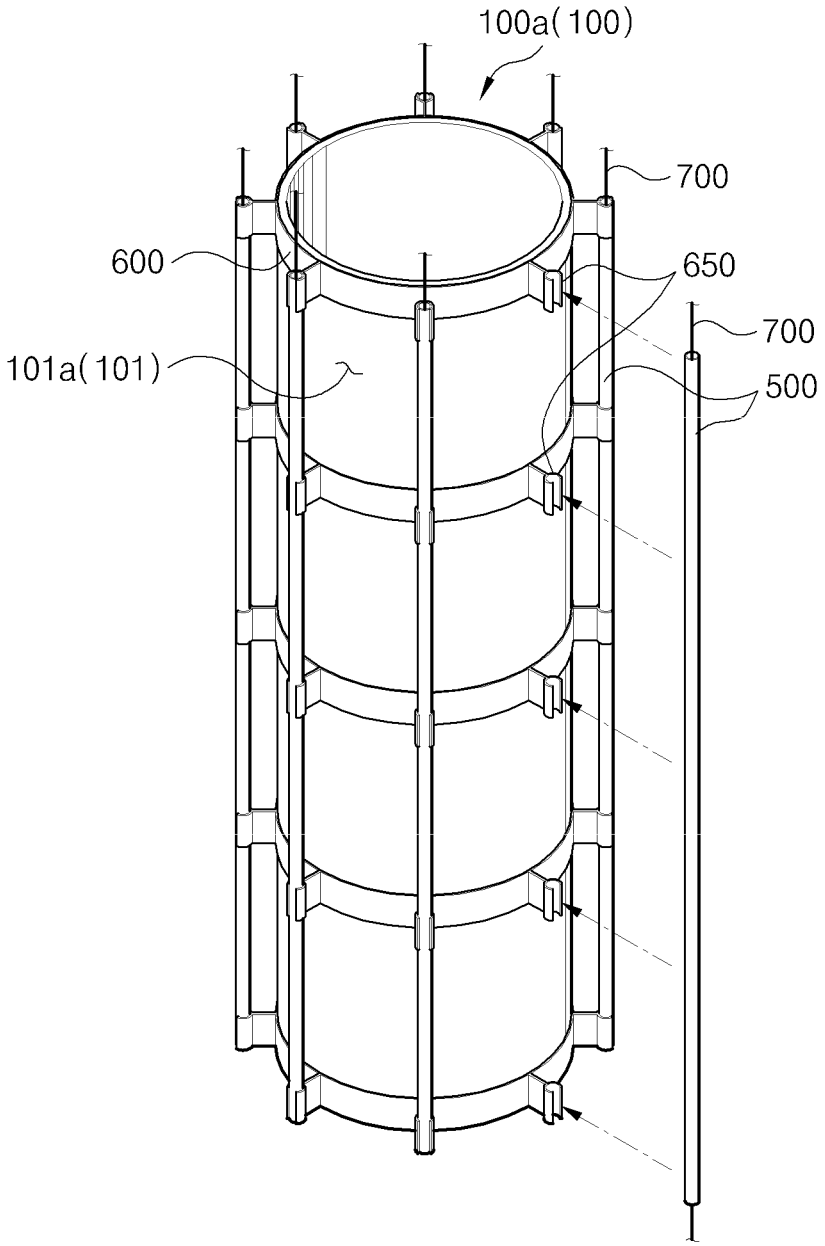
FIG. 4 is a perspective view illustrating a coupling relationship between a duct and an inner mold illustrated in FIG. 1.

FIG. 1 is a perspective view illustrating a hollow-core structure asper a first embodiment of the present invention, FIG. 2 is a longitudinal cross-sectional view of the hollow-core structure illustrated in FIG. 1, FIG. 3 is a plan cross-sectional view of the hollow-core structure illustrated in FIG. 1, and FIG. 4 is a perspective view illustrating a coupling relationship between an inner mold and a duct illustrated in FIG. 1.

Referring to the drawings, a hollow-core structure 10*a* (10) asper a first embodiment of the present invention has an inner hollow portion so as to reduce the total weight, and includes an inner mold 100*a* (100), an outer mold 200*a* (200), and a filling member 300*a* (300).

The inner mold 100*a* has a hollow cylindrical shell shape. The inner mold 100*a* is preferably formed by molding a plastic material. However, any material may be used as long as a material has durability and structural stiffness suitable for purpose, and the material of the inner mold is particularly not limited.

The outer mold 200*a* has a hollow cylindrical shell shape to correspond to the inner mold 100*a*. Further, the inner mold 100*a* is disposed inside the outer mold 200*a* to be separated. Here, the outer mold 200*a* is also preferably formed by molding a plastic material, but the material of the outer mold is not particularly limited.

A separation space between the inner mold 100*a* and the outer mold 200*a* is filled with the filling member 300*a*. Concrete may be used as the filling member 300*a*. That is, after fluidity concrete is cast in the separation space between the inner mold 100*a* and the outer mold 200*a* and the cast concrete is cured, the cured concrete can be filled in the separation space between the inner mold 100*a* and the outer mold 200*a*. In this case, a separation distance between the inner mold 100*a* and the outer mold 200*a* becomes a thickness of the cast concrete. Here, when necessary, reinforcement steel or a reinforcement material such as reinforcing fiber is embedded into the concrete, so that it is possible to reinforce structural stiffness. Furthermore, the concrete may be cast-in-place concrete, or may be used after being previously cast and cured.

In the first embodiment of the present invention described above, the hollow-core structure 10*a* (10) may further include a confinement unit 400 that is provided to surround an outer peripheral surface 201 of the outer mold 200*a* to confine the outer mold 200*a*. As the confinement unit 400, a carbon fiber reinforced polymer (CFRP) material that is wound around the outer peripheral surface 201 of the outer mold 200*a* by a plurality of turns may be used. However, this material is merely an example, and as the confinement unit 400, any material may be used as long as it has structural stiffness capable of sufficiently withstanding an external load and replacing the carbon fiber reinforced polymer material.

Meanwhile, a method of minimizing the influence of an external force exerted in use by previously exerting a compressive stress on concrete by using prestressing tendons such as piano wires or special steel wires may apply to prestressed concrete. That is, when a high compressive force is exerted on the concrete by using the prestressing tendons, since a tensile stress is canceled by the compressive force of the prestressing tendons, the structure is not substantially affected by a high tensile stress.

A plurality of ducts 500 may be arranged radially in the longitudinal direction of the inner mold 100*a* to be separated from an outer peripheral surface 101*a* of the inner mold 100*a* as illustrated in FIG. 4 such that prestressing tendons 700 for exerting a prestressing force described above are arranged radially between the inner mold 100*a* and the outer mold 200*a*. The duct 500 has a flexible pipe shape or a corrugated shape, and has an inner space for accommodating the prestressing tendon 700.

A duct fixing unit 600 provided with a plurality of holders 650 for easily providing the plurality of ducts 500 may be further provided on the outer peripheral surface 101*a* of the inner mold 100*a*. Here, the duct fixing unit 600 is coupled to surround the outer peripheral surface 101*a* of the inner mold 100*a*. The plurality of holders 650 may be arranged to correspond to the ducts 500, and the ducts 500 may be detachably coupled to the respective holders 650.

Hereinafter, a method of manufacturing the hollow-core structure 10*a* asper the first embodiment of the present invention described above will be described with reference to the accompanying drawings.

Figure 18:
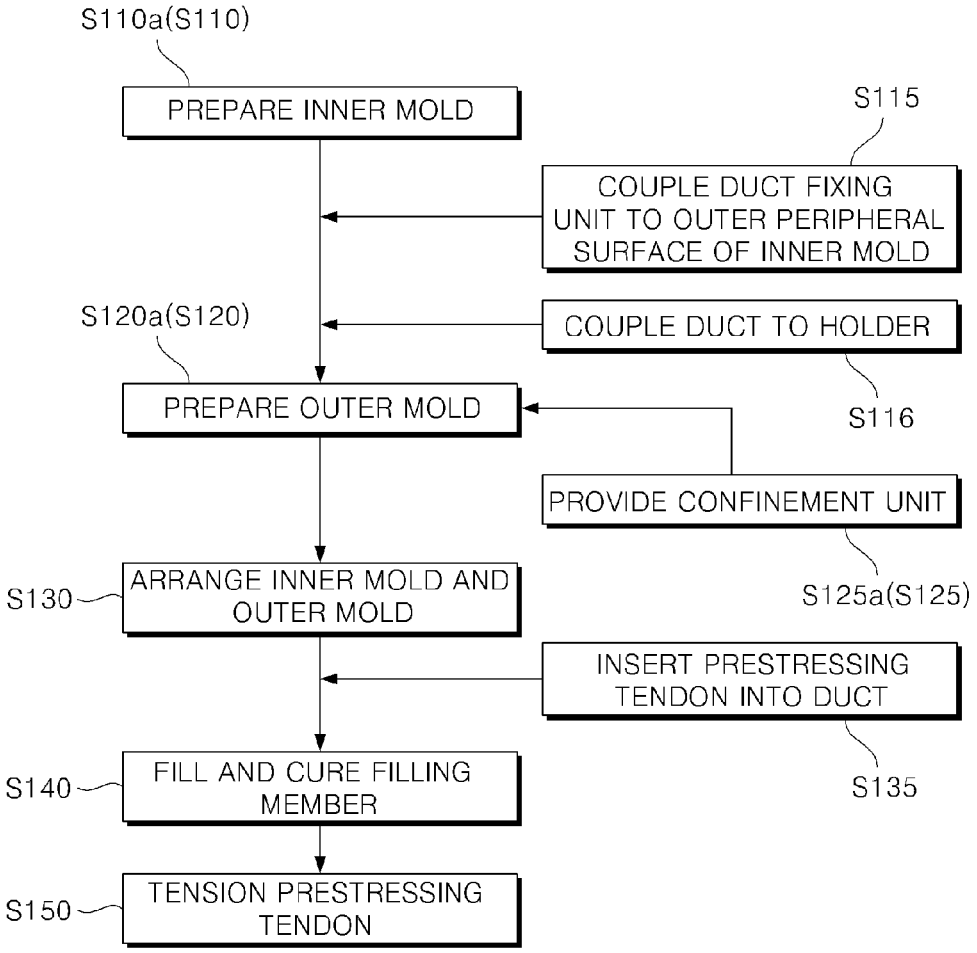
FIG. 18 is a flowchart illustrating a method of manufacturing the hollow-core structure asper the first embodiment of the present invention illustrated in FIG. 1.

FIG. 18 is a flowchart illustrating the method of manufacturing the hollow-core structure 10*a* according to the first embodiment of the present invention illustrated in FIG. 1.

Referring to FIGS. 1 to 4 and 18, the inner mold 100*a* having a hollow cylindrical shell shape is first prepared (S110*a*; S110). The inner mold 100*a* may be formed by molding a plastic material, and the material of the inner mold is not particularly limited.

Meanwhile, after the inner mold 100*a* is prepared, in order to provide the ducts 500 for accommodating the prestressing tendons 700 for exerting the prestressing force, the duct fixing unit 600 provided with the plurality of holders 650 that can be arranged radially may be coupled to be separated from the outer peripheral surface 101*a* of the inner mold 100*a* (S115). Thereafter, the plurality of ducts 500 into which the prestressing tendons 700 can be inserted may be detachably coupled to the holders 650 (S116).

When the inner mold 100*a* is prepared, the outer mold 200*a* which has a hollow cylindrical shell shape to correspond to the prepared inner mold 100*a* and into which the inner mold 100*a* can be inserted to be separated is prepared (S120*a*; S120). The outer mold 200*a* may also be formed by molding a plastic material, but the material of the outer mold is not particularly limited.

On the other hand, the step of preparing the outer mold 200*a* includes providing the confinement unit 400 that is provided to surround the outer peripheral surface 201 of the outer mold 200*a* and confines the outer mold 200*a* (S125*a*; S125). In this case, a carbon fiber reinforced polymer (CFRP) material that is wound around the outer peripheral surface 201 of the outer mold 200*a* by a plurality of turns may be used as the confinement unit 400.

Subsequently, the inner mold 100*a* and the outer mold 200*a* are arranged such that the inner mold 100*a* is disposed inside the outer mold 200*a* to be separated (S130). In this case, a separation distance between the inner mold 100*a* and the outer mold 200*a* becomes a thickness of the filling member 300*a* to be cast later.

As stated above, after the inner mold 100*a* and the outer mold 200*a* are arranged (S130), the prestressing tendons 700 are inserted into the ducts 500 (S135).

Thereafter, the separation space between the inner mold 100*a* and the outer mold 200*a* is filled with the fluidity filling material 300*a* and the filling material is cured (S140). Here, concrete may be used as the filling member 300*a*, and reinforcement steel or a reinforcing material including reinforcing fiber may be embedded into the concrete. However, the material of the filling member is not particularly limited.

When the filling and curing of the filling material 300 (300*a*) are completed (S140), the prestressing tendons 700 are ultimately tensioned (S150) to finish the hollow-core structure 10*a* asper the first embodiment of the present invention.

As described above, in accordance with the hollow-core structure 10*a* asper the first embodiment of the present invention and the manufacturing method thereof, by forming the hollow portion in the structure, the structure can be variously applied as in a case where an intermediate structure such as a ladder or a floor is provided. Further, the total weight thereof can be reduced, and distribution cost thereof can be reduced.

By inherently confining the outer peripheral surface 201 of the outer mold 200*a* by means of the confinement unit 400 such as the carbon fiber reinforced polymer material, it is possible to maximize compressive strength, and it is possible to secure safety against a probable local buckiling.

It has been described in the aforementioned first embodiment that the hollow-core structure 10*a* includes one inner mold 100*a* and one outer mold 200*a*. However, in a large-sized structure, due to a difficulty in manufacturing and transferring the structure, a method of dividing the molds into a plurality of portions to manufacture and transferring the plurality of manufactured portions to be assembled later may be considered.

Hereinafter, there will be described a hollow-core structure asper a second embodiment of the present invention, and the hollow-core structure includes an inner molds and outer molds provided in a plurality of units.

Figure 5:
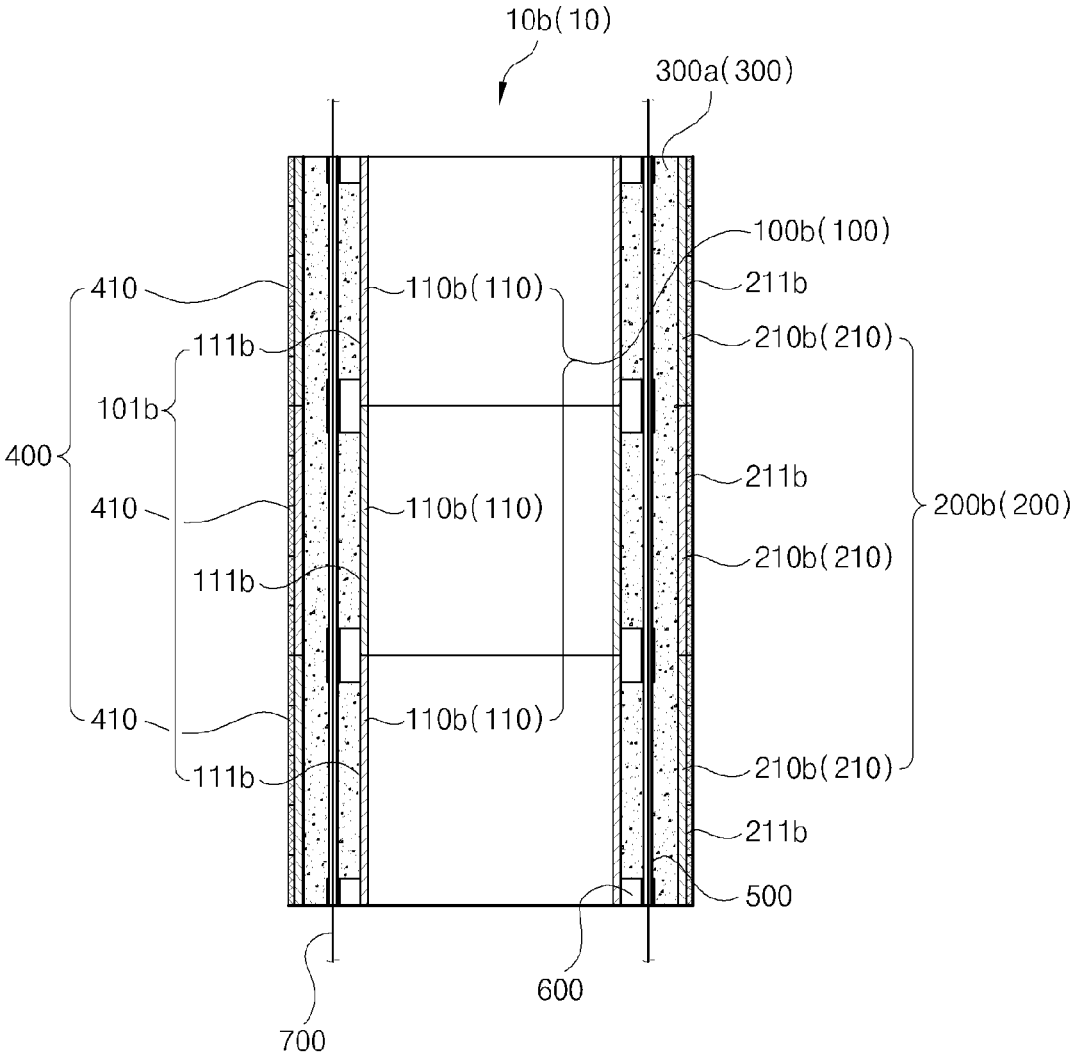
FIG. 5 is a longitudinal cross-sectional view of a hollow-core structure asper a second embodiment of the present invention.
Figure 6:
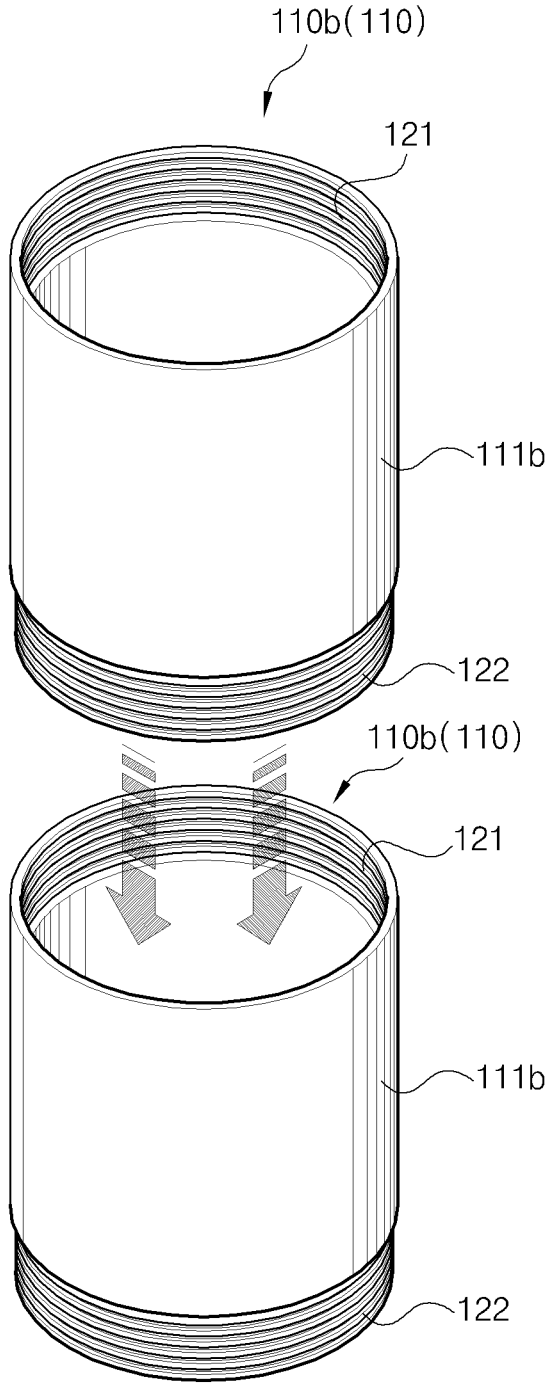
FIG. 6 is a perspective view illustrating an individual inner mold illustrated in FIG. 5.
Figure 7:
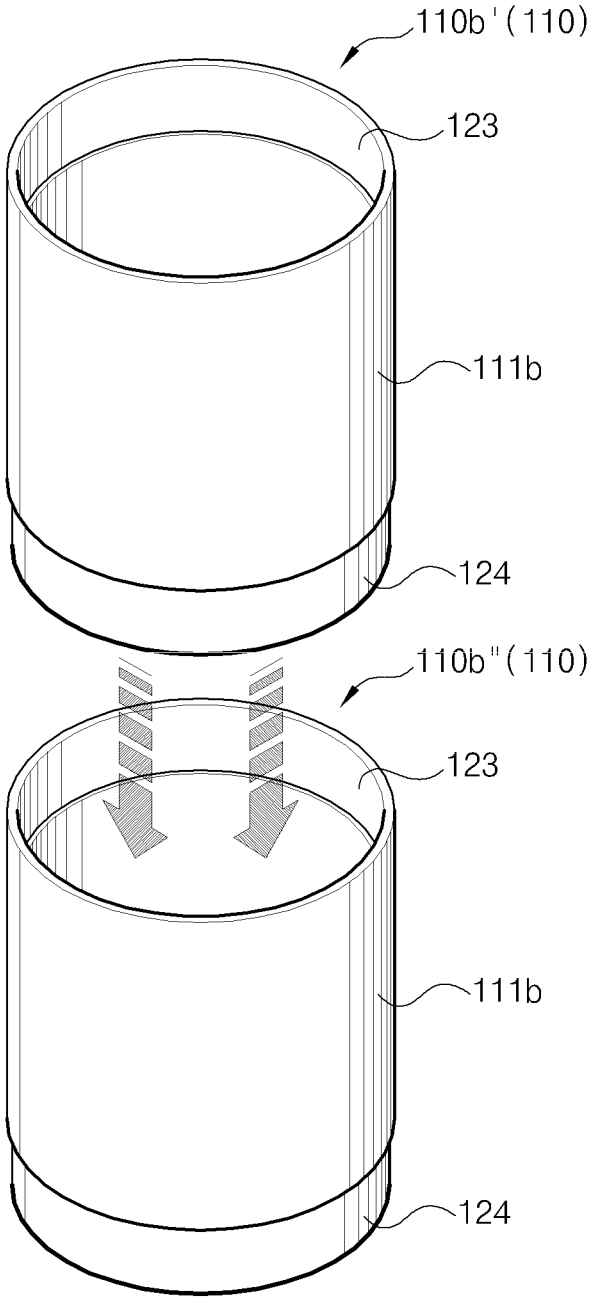
FIG. 7 is a perspective view illustrating another embodiment of the individual inner mold illustrated in FIG. 6.
Figure 8:
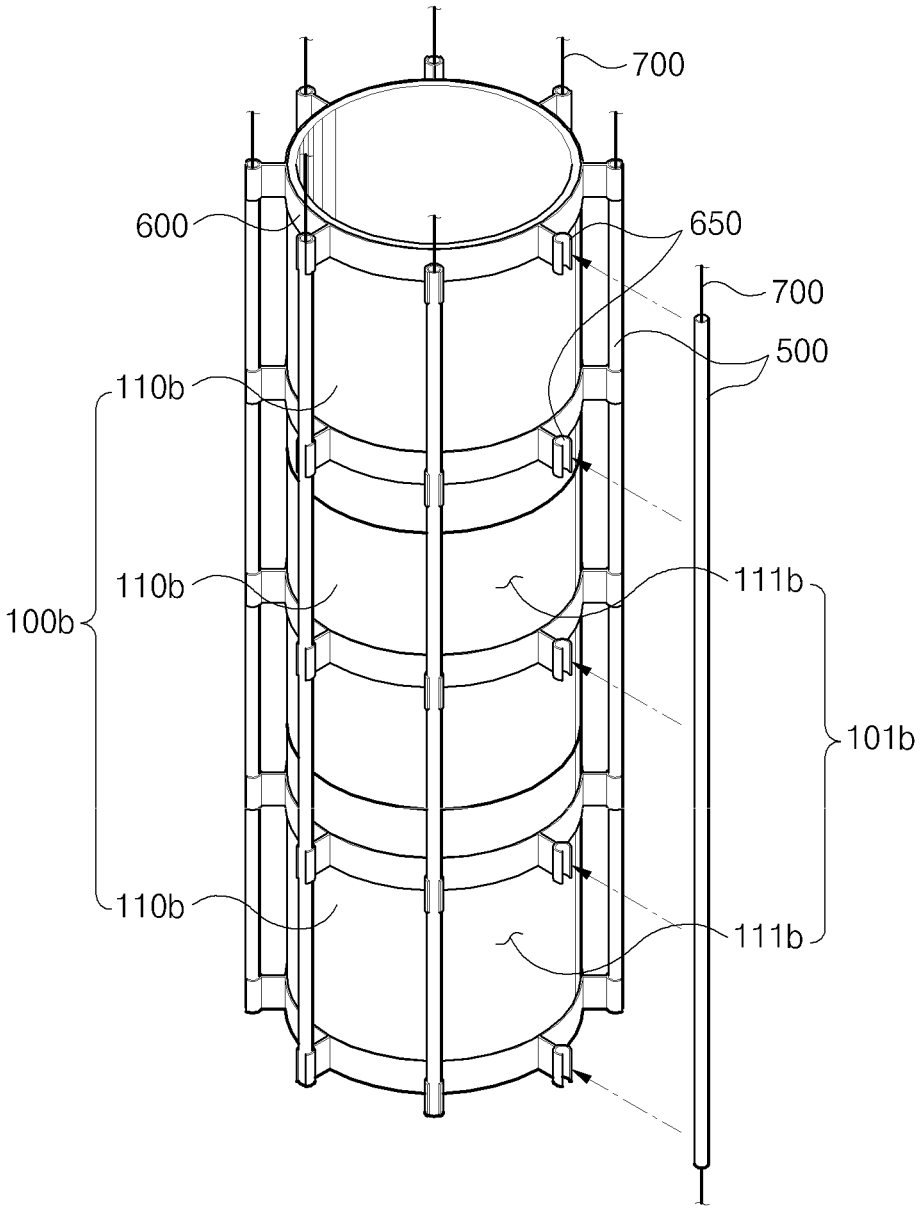
FIG. 8 is a perspective view illustrating a coupling relationship of a duct and an inner mold illustrated in FIG. 5.
Figure 9:
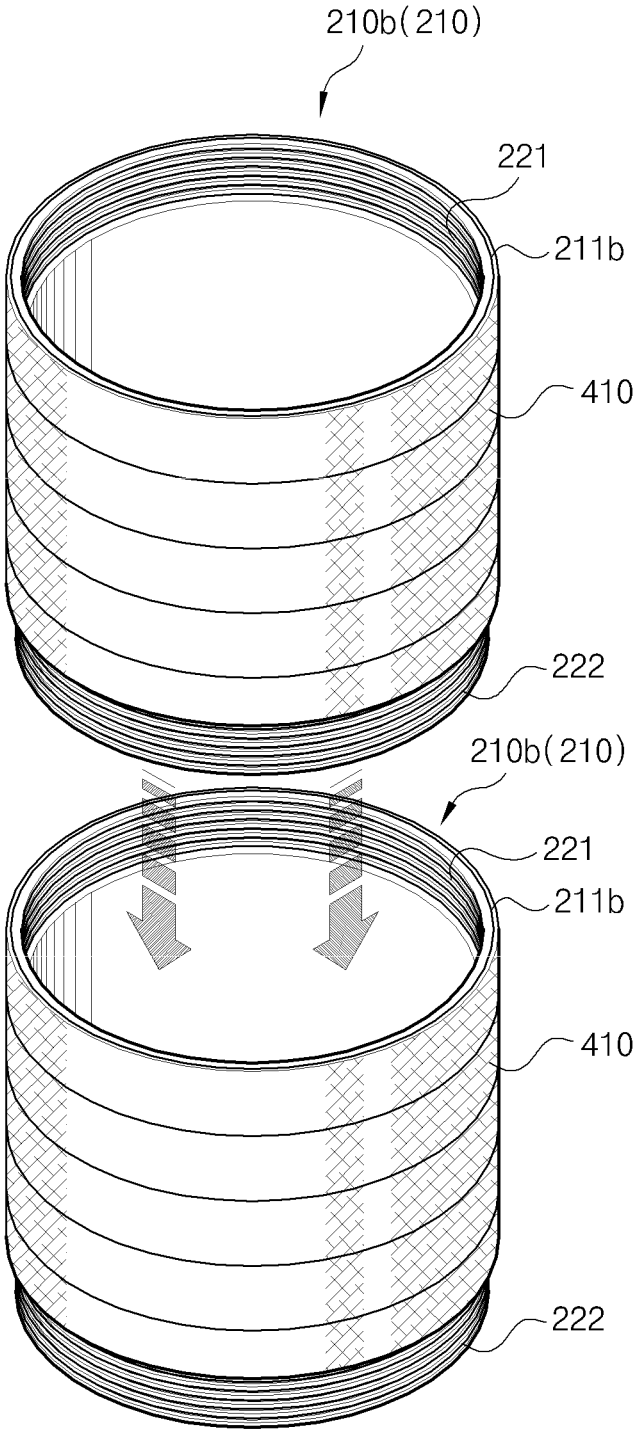
FIG. 9 is a perspective view illustrating an individual outer mold illustrated in FIG. 5.
Figure 10:
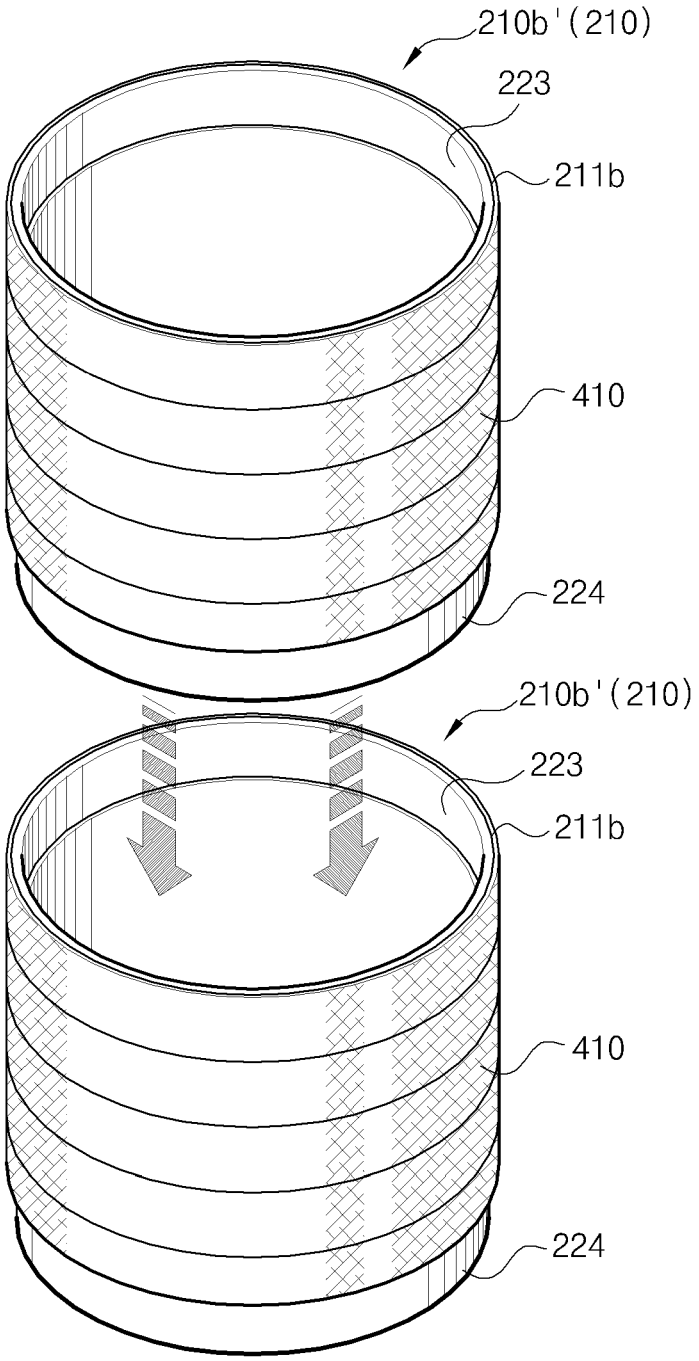
FIG. 10 is a perspective view illustrating another embodiment of the individual outer mold illustrated in FIG. 9.

FIG. 5 is a longitudinal cross-sectional view of the hollow-core structure asper the second embodiment of the present invention, FIG. 6 is a perspective view illustrating an individual inner mold illustrated in FIG. 5, FIG. 7 is a perspective view illustrating another example of the individual inner mold illustrated in FIG. 6, FIG. 8 is a perspective view illustrating a coupling relationship between the inner mold and the duct illustrated in FIG. 5, FIG. 9 is a perspective view illustrating an individual outer mold illustrated in FIG. 5, and FIG. 10 is a perspective view illustrating another example of the individual outer mold illustrated in FIG. 9.

Here, the same reference numerals as those in FIGS. 1 to 4 represent the same components having the same operations and effects, and, thus, the redundant description thereof will not be presented. Differences between the second embodiment and the first embodiment will be mainly described.

Referring to the drawings, a hollow-core structure 10*b* (10) asper the second embodiment of the present invention includes an inner mold 100*b* (100), an outer mold 200*b* (200), and a filling member 300*a* (300).

In the second embodiment of the present invention described above, the inner mold 100*b* includes a plurality of individual inner molds 110*b* (110) divided to be layered as illustrated in FIG. 5. The outer mold 200*b* also includes a plurality of individual outer molds 210*b* (210) divided to be layered to correspond to the plurality of individual inner molds 110*b*.

Referring to FIGS. 6, 7, 9 and 10, the individual inner molds 110*b* and the individual outer molds 210*b* that are divided to be layered and are vertically adjacent to each other may be coupled in a female and male coupling manner. Specifically, as illustrated in FIG. 6, the individual inner molds 110*b* may be detachably screwed using female screws 121 and male screws 122 that are provided at ends thereof in a longitudinal direction. The individual outer molds 210*b* may also be detachably screwed by female screws 211 and male screws 222 that are respectively provided at ends thereof in the longitudinal direction. As an alternative of the screw-coupling, individual inner molds 110*b*' divided to be layered as illustrated in FIG. 7 may be slidably coupled by stepped portions 123 and 124 that are respectively formed at ends thereof in the longitudinal direction. As illustrated in FIG. 10, individual outer molds 210*b*' may also be slidably coupled by stepped portions 223 and 224 that are respectively formed at the ends thereof in the longitudinal direction. However, the individual inner molds 110*b* or 110*b*' and the individual outer molds 210*b* or 210*b*' that are vertically adjacent to each other may be coupled by various methods other than the female and male coupling manner such as the screw-coupling or the sliding-coupling as long as the individual molds are detachably coupled.

As illustrated in FIG. 8, the plurality of ducts 500 may be provided in the longitudinal direction of the inner mold 100*b* to be separated from an outer peripheral surface 101*b* of the inner mold 100*b* such that the prestressing tendons 700 can be arranged radially between the inner mold 100*b* and the outer mold 200*b*. To achieve this, the duct fixing unit 600 provided with the plurality of holders 650 for detachably coupling the ducts 500 to correspond to the plurality of ducts 500 may be coupled to surround the outer peripheral surface 101*b* of the inner mold 100*b*.

Meanwhile, as illustrated in FIGS. 5 and 9, the hollow-core structure 10*b* may further include a plurality of individual confinement units 410 that is provided to independently surround outer peripheral surfaces 211*b* of the individual outer molds 210*b* and independently confines the individual outer molds 210*b*. Here, as the individual confinement unit 410, a carbon fiber reinforced polymer (CFRP) material that is wound around the outer peripheral surface 211*b* of the individual outer mold 210*b* by a plurality of turns may be used.

The filling material 300*a* is filled in a separation space between the inner mold 100*b* and the outer mold 200*b* that are divided to be layered and are separated from each other as illustrated in FIG. 5. Concrete may be used as the filling material 300*a*, and reinforcement steel or a reinforcing material including reinforcing fiber may be embedded inside the concrete. However, the material of the filling member 300*a* is not particularly limited.

Hereinafter, a method of manufacturing the hollow-core structure 10*b* asper the second embodiment of the present invention described above will be described with reference to the accompanying drawings.

Figure 19:
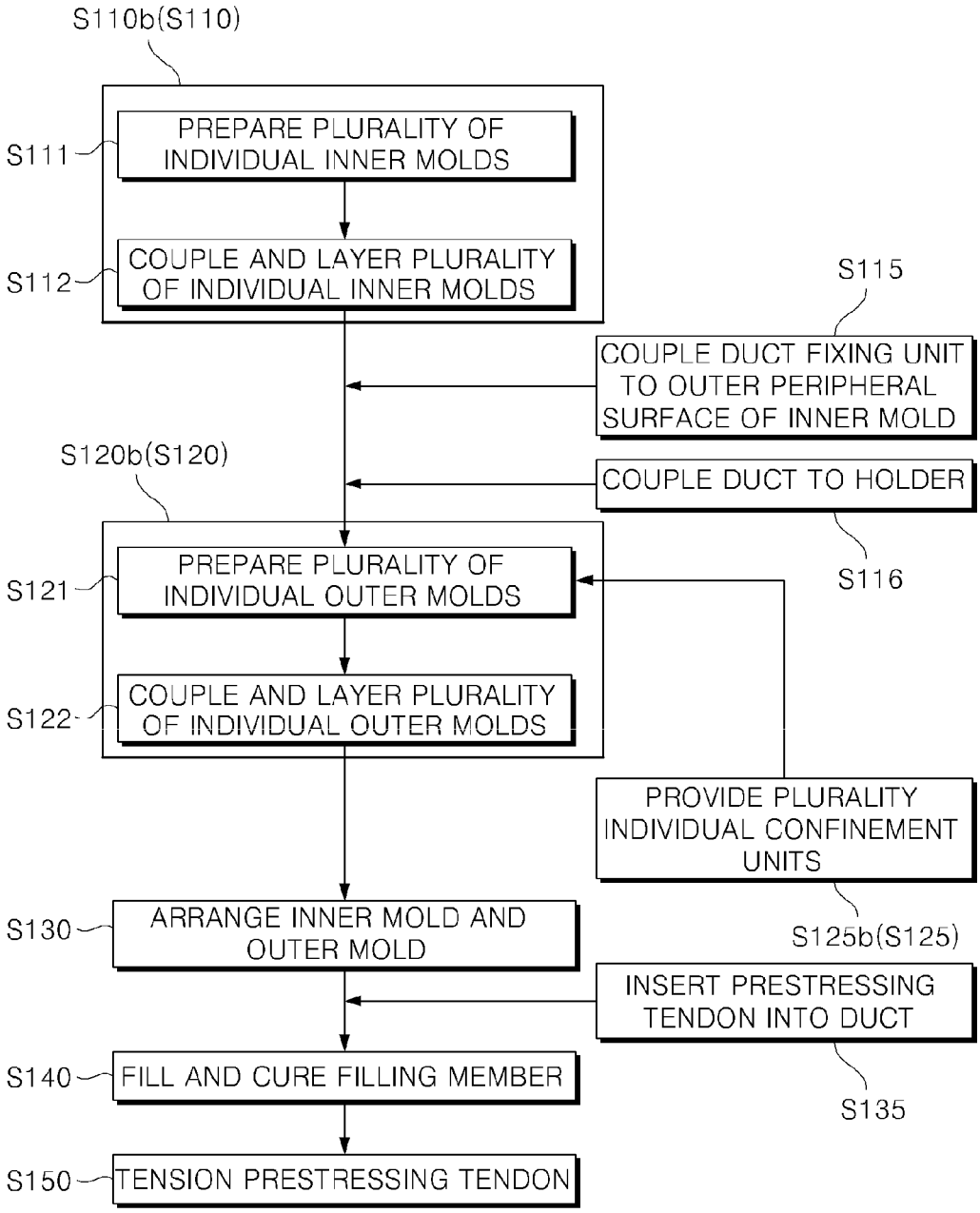
FIG. 19 is a flowchart illustrating a method of manufacturing the hollow-core structure according to the second embodiment of the present invention illustrated in FIG. 5.

FIG. 19 is a flowchart illustrating the method of manufacturing the hollow-core structure asper the second embodiment of the present invention illustrated in FIG. 5. Here, the same reference numerals as those in FIG. 18 represent the same components having the same operations and effects.

Referring to FIGS. 5 to 10, and 19, the inner mold 100*b* having a hollow cylindrical shell shape is prepared (S110*b*; S110). In order to prepare the inner mold 100*b*, the plurality of individual inner molds 110*b* is first prepared (S111). Thereafter, the plurality of individual inner molds 110*b* is coupled to each other and are layered (S112). Here, the individual inner molds 110*b* may be coupled in a female and male, such as screw-coupling illustrated in FIG. 6 or the sliding-coupling illustrated in FIG. 7.

Meanwhile, after the plurality of individual inner molds 110*b* is coupled to each other and layered, in order to provide the ducts 500 for exerting the prestressing later, the duct fixing unit 600 provided with the plurality of holders 650 that can be arranged radially may be coupled to be separated from the outer peripheral surface 101*b* of the inner mold 100*b* (S115). Subsequently, the plurality of ducts 500 into which the prestressing tendons 700 can be inserted may be detachably coupled to the holders 650 (S116).

Thereafter, the outer mold 200*b* which has a hollow cylindrical shell shape to correspond to the prepared inner mold 100*b* and into which the inner mold 100*b* can be inserted to be separated is prepared (S120*b*; S120). In order to prepare the outer mold 200*b*, the plurality of individual outer molds 210*b* is first prepared (S121). Thereafter, the plurality of individual outer molds 210*b* is coupled to each other and layered (S122). Here, the individual outer molds 210*b* may be coupled in a female and male coupling manner, such as the screw-coupling illustrated in FIG. 6 or the sliding-coupling illustrated in FIG. 7.

Meanwhile, as illustrated in FIG. 8, the step of preparing the individual outer molds 210*b* may include providing the plurality of individual confinement units 410 that independently surrounds the outer peripheral surfaces 211*b* of the individual outer molds 210*b* to independently confine the individual outer molds 210*b* (S125*b*; S125). Here, as the plurality of individual confinement units 410, a carbon fiber reinforced polymer (CFRP) material that is wound around the outer peripheral surface 211*b* of the individual outer mold 210*b* by a plurality of turns may be used.

Subsequently, the inner mold 100*b* and the outer mold 200*b* are arranged by inserting the inner mold 100*b* into the outer mold 200*b* to be separated (S130).

After the inner mold 100*b* and the outer mold 200*b* are arranged as described above (S130), the prestressing tendons 700 are inserted into the ducts 500 (S135).

Subsequently, a separation space between the inner mold 100*b* and the outer mold 200*b* is filled with the fluidity filling material 300*a*, and the filling material is cured (S140).

When the filling and curing of the filling material 300 (300*a*) are completed (S140), the prestressing tendons 700 are ultimately tensioned (S150) to finish the hollow-core structure 10*b* asper the second embodiment of the present invention.

As stated above, in accordance with the hollow-core structure 10*b* asper the second embodiment of the present invention and the manufacturing method thereof, the inner mold 100*b* and the outer mold 200*b* are manufactured by being respectively divided into a plurality of inner molds and a plurality of outer molds. The plurality of inner molds and the plurality of outer molds can be expanded by being detachably coupled to each other. Thus, it is possible to easily manufacture and transfer the hollow-core structure, and it is possible to systemize the hollow-core structure for mass production.

Further, it is possible to apply the hollow-core structure to a precast concrete structure as well as the cast-in-place concrete. In addition, compared to the steel structure according to the related art, the hollow-core structure according to the present invention can be easily manufactured, and can have economic advantages.

Hereinafter, a hollow-core structure asper a third embodiment of the present invention will be described, and the hollow-core structure includes an inner mold and an outer mold that are respectively formed in a plurality of individual molds.

Figure 11:
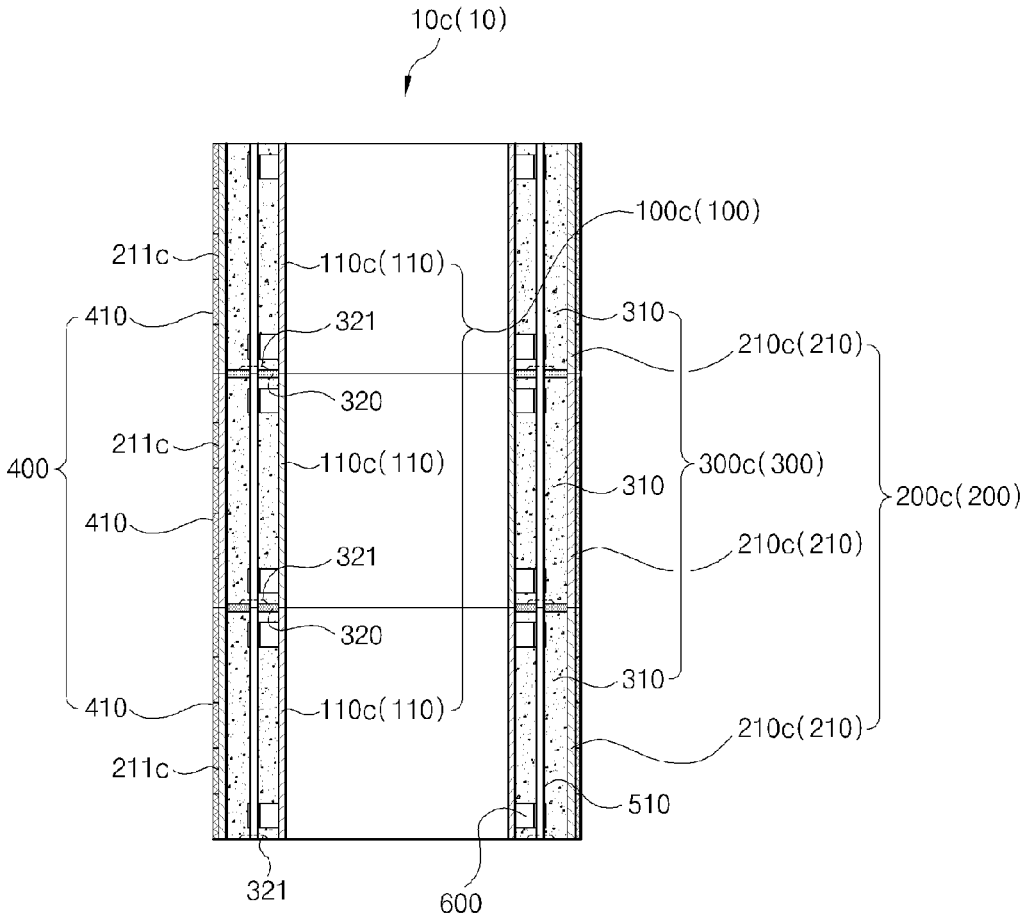
FIG. 11 is a longitudinal cross-sectional view of a hollow-core structure asper a third embodiment of the present invention.
Figure 14:
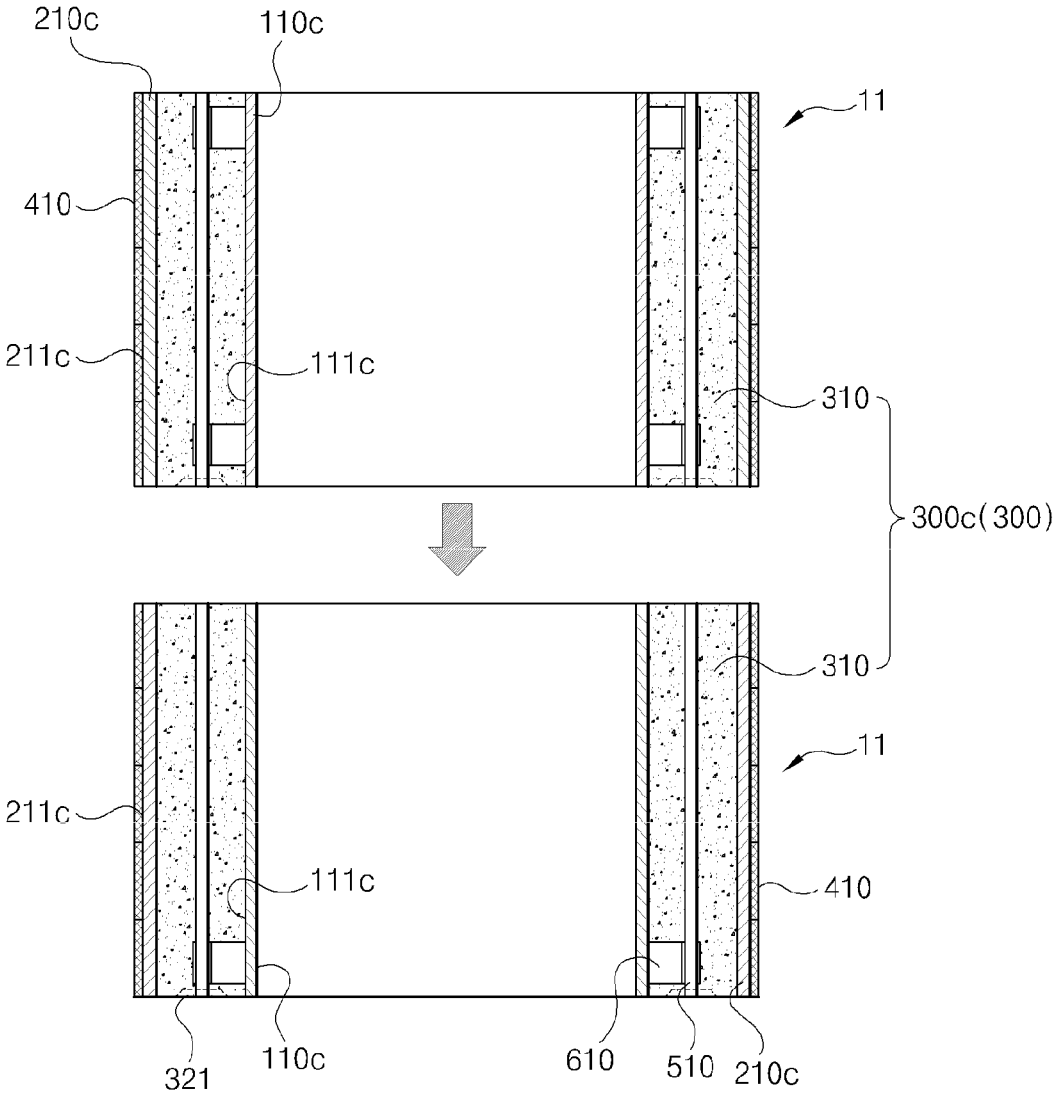
FIG. 14 is a cross-sectional view illustrating a state where a filling member, the outer mold and the inner mold illustrated in FIG. 11 are coupled.

FIG. 11 is a longitudinal cross-sectional view of the hollow-core structure asper the third embodiment of the present invention, FIG. 12 is a perspective view of the inner mold illustrated in FIG. 11, FIG. 13 is a perspective view illustrating the outer mold illustrated in FIG. 11, and FIG. 14 is a cross-sectional view illustrating a state where a filling member, the outer mold and the inner mold illustrated in FIG. 11 are coupled.

Here, the same reference numerals as those in FIGS. 1 to 10 represent the same components having the same operations and effects, and redundant description thereof will not be presented. Differences between the third embodiment and the first embodiment will be mainly described.

Referring to the drawings, a hollow-core structure 10*c* (10) asper the third embodiment of the present invention includes an inner mold 100*c* (100), an outer mold 200*c* (200), and a filling member 300*c* (300).

In the third embodiment of the present invention described above, the inner mold 100*c* includes a plurality of individual inner molds 110*c* (110) that is divided to be layered as illustrated in FIGS. 11 and 12. The outer mold 200*c* also includes a plurality of individual outer molds 210*c* (210) that is divided to be layered to correspond to the plurality of individual inner molds 110*c* as illustrated in FIGS. 11 and 13.

Meanwhile, the hollow-core structure 10*c* may further include a plurality of individual confinement unit 410 that is provided to surround outer peripheral surfaces 211*c* of the individual outer molds 210*c* that are divided to be layered and independently confines the individual outer molds 210*c*. Here, as the individual confinement unit 410, a carbon fiber reinforced polymer (CFRP) material that is wound around the outer peripheral surfaces 211*c* of the individual outer molds 210*c* by a plurality of turns may be used.

The filling member 300*c* may include a plurality of individual filling members 310 that are divided to be layered to correspond to the individual inner molds 110*c* and the individual outer molds 210*c* that are divided to be layered as illustrated in FIGS. 11 and 14. The individual filling members 310 are filled in separation spaces between the individual inner molds 110*c* and the individual outer molds 210*c* that are arranged to be separated from each other. Concrete may be used as the individual filling member 310, and reinforcement steel or a reinforcing material including reinforcing fiber may be embedded inside the concrete. However, the material of the individual filling member 310 is not particularly limited.

The hollow-core structure 10*c* asper the third embodiment of the present invention described above is finished by layering a plurality of individual hollow-core structures 11 including the individual inner molds 110*c*, the individual outer molds 210*c* and the individual filling members 310*c*. In this case, a non-shrink and high-strength mortar layer 320 that is filled with a non-shrink and high-strength mortar is interposed between the individual filling members 310 that are divided to be layered as illustrated in FIG. 11, and the individual filling members 310 may be coupled to each other such that stresses on contact surfaces between the individual filling members that vertically come in contact with each other are uniformly distributed. Moreover, shear keys 321 are interposed at lower ends of the individual filling members 310 that are divided to be layered, and, thus, it is possible to reinforce the coupling of the individual filling members 310 that vertically come in contact with each other. Accordingly, the plurality of divided individual hollow structures 11 can be easily layered in a vertical direction.

As illustrated in FIG. 12, a plurality of individual ducts 510 may be provided in the longitudinal direction of the individual inner mold 110*c* such that the prestressing tendons 700 are arranged radially to be separated from outer peripheral surfaces 111*c* of the individual inner molds 110*c* to be inserted. To achieve this, individual duct fixing units 610 provided with a plurality of individual holders 651 capable of detachably coupling the individual ducts 510 to correspond to the individual ducts 510 may be coupled to surround the outer peripheral surfaces 111*c* of the individual inner molds 110*c*. Here, after the plurality of individual hollow-core structures 11 are layered, the plurality of individual ducts 510 needs to be vertically aligned in parallel with each other. To achieve this, the individual ducts 510 need to be arranged on a constant phase with coupling positions of the individual filling members 310 as a reference.

Hereinafter, a method of manufacturing the hollow structure 10*c* asper the third embodiment of the present invention mentioned above will be described with the accompanying drawings.

Figure 20:
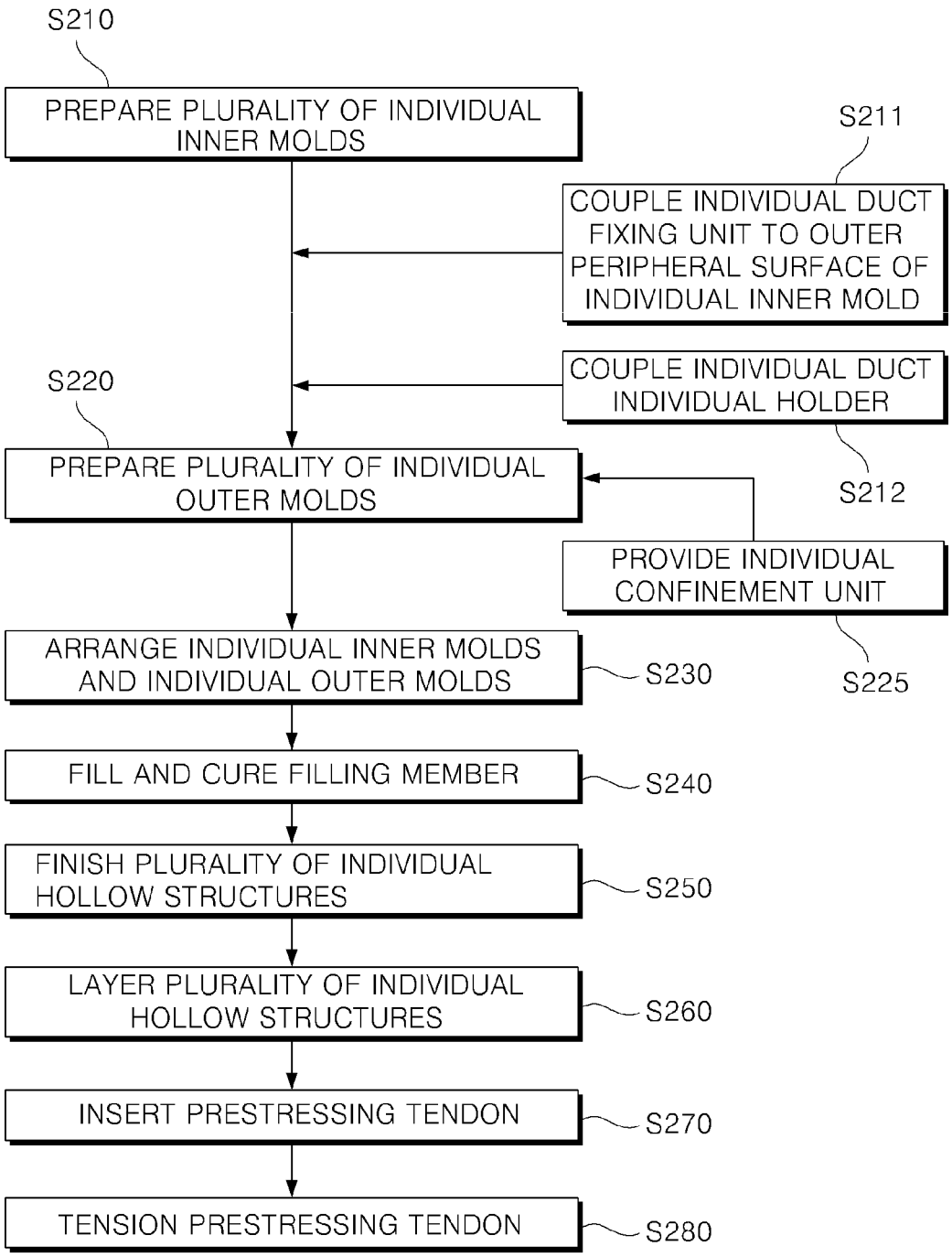
FIG. 20 is a flowchart illustrating a method of manufacturing the hollow-core structure asper the third embodiment of the present invention illustrated in FIG. 11.

FIG. 20 is a flowchart illustrating the method of manufacturing the hollow-core structure according to the third embodiment of the present invention illustrated in FIG. 11.

Referring to FIGS. 11 to 14 and 20, the plurality of individual inner molds 110*c* having a hollow cylindrical shell shape is first prepared (S210). When the plurality of individual inner molds 110*c* is prepared, the individual duct fixing units 610 provided with the plurality of individual holders 651 capable of being arranged radially to be separated from the outer peripheral surfaces 111*c* of the individual inner molds 110*c* may be coupled to the outer peripheral surfaces 111*c* of the individual inner molds 110*c* (S211). Here, the plurality of individual ducts 510 into which the prestressing tendons 700 can be inserted are detachably coupled to the individual holders 651 (S212).

Subsequently, the plurality of individual outer molds 210*c* that has a hollow cylindrical shell shape to correspond to the individual inner molds 110*c* and into which the individual inner molds 110*c* are inserted to be separated are prepared (S220). When the plurality of individual outer molds 210*c* is prepared, the individual confinement units 410 that surround the outer peripheral surfaces 211*c* of the individual outer molds 210*c* to confine the individual outer molds 210*c* may be provided. Here, as the individual confinement unit 410, a carbon fiber reinforced polymer (CFRP) material that is wound around the outer peripheral surfaces 211*c* of the individual outer molds 210*c* by a plurality of turns may be used.

Thereafter, the individual inner molds 110*c* and the individual outer molds 210*c* are arranged by inserting the individual inner molds 110*c* into the individual outer molds 210*c* to be separated.

Subsequently, the fluidity individual filling material 310 are filled in separation spaces between the individual inner molds 110*c* and the individual outer molds 210*c*, and the individual filling members are cured (S240). Concrete may be used as the individual filling material 310, and reinforcement steel or a reinforcing material including reinforcing fiber may be embedded inside the concrete. However, the material of the individual filling member 310 is not particularly limited.

In the third embodiment of the present invention described above, the plurality of individual hollow structures 11 are finished by repeating the step S230 of arranging the individual inner molds 110*c* and the individual outer molds 210*c* and the step S240 of filling and curing the individual filling material 310 (S250).

When the plurality of individual hollow structures 11 is finished (S250), the plurality of individual hollow structures 11 is vertically layered (S260). In this case, it is preferred that non-shrink and high-strength mortar layers 320 that are filled with non-shrink and high-strength mortars be interposed between the individual filling members 310 that are divided to be layered and the individual filling members 310 be coupled to each other such that stresses on contact surfaces between the individual filling members 310 that vertically come in contact with each other are uniformly distributed. In addition, shear keys 321 are interposed at lower ends of the individual filling members 310 that are divided to be layered, and, thus, it is possible to reinforce the coupling between the individual filling members 310 that vertically come in contact with each other. Meanwhile, after the plurality of individual hollow-core structures 11 is layered, the plurality of individual ducts 510 needs to be vertically aligned in parallel. To achieve this, the individual ducts 510 need to be arranged on a constant phase with coupling positions of the individual filling members 310 as a reference.

Ultimately, the prestressing tendons 700 are inserted into the plurality of individual ducts 510 (S270). Thereafter, the prestressing tendons 700 are tensioned (S280) to finish the hollow-core structure 10*c* according to the third embodiment of the present invention.

As stated above, in accordance with the hollow structure 10*c* asper the third embodiment of the present invention and the manufacturing method thereof, the plurality of individual hollow structures 11 including the individual inner molds 110*c*, the individual outer molds 210*c* and the individual filling members 310 is manufactured, and the individual hollow-core structures can be expanded by being detachably coupled to each other. Accordingly, it is possible to easily manufacture and transfer the hollow structure, and it is possible to systemize the hollow-core structure for mass production.

It is possible to apply the hollow-core structure to the precast concrete structure as well as the cast-in-place concrete. Compared to the steel structure according to the related art, the hollow structure according to the present invention can be easily manufactured, and can have economic advantages.

Figure 15:
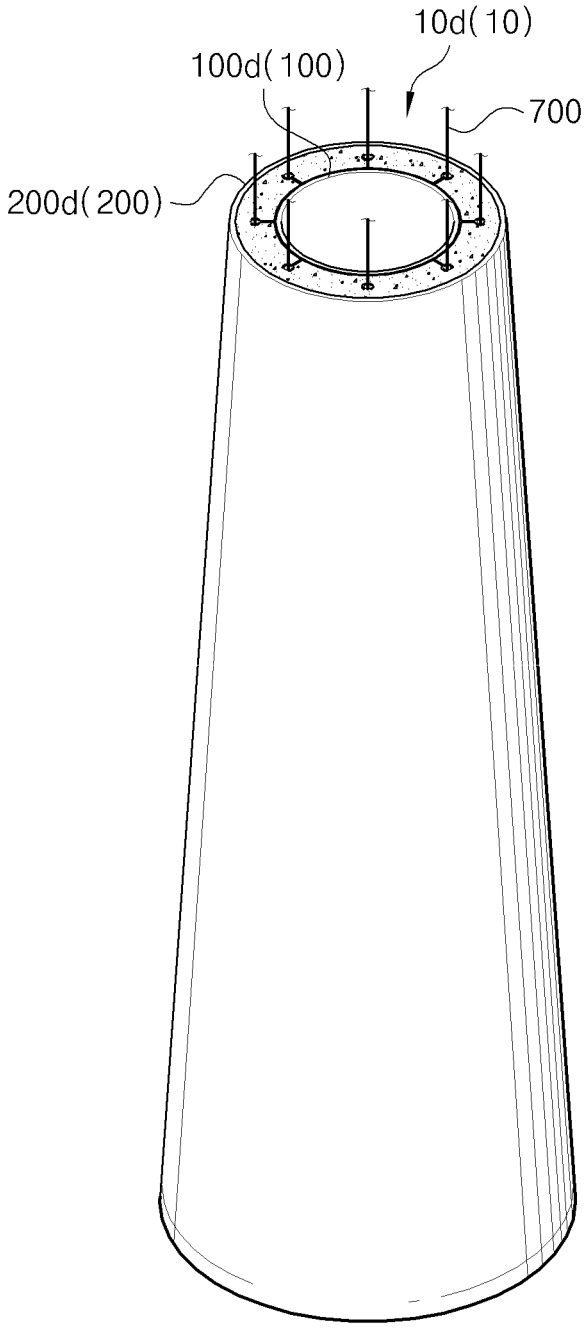
FIGS. 15 to 17 are perspective views illustrating structural modification examples of the hollow structure illustrated in FIGS. 1, 5 and 11.
Figure 16:
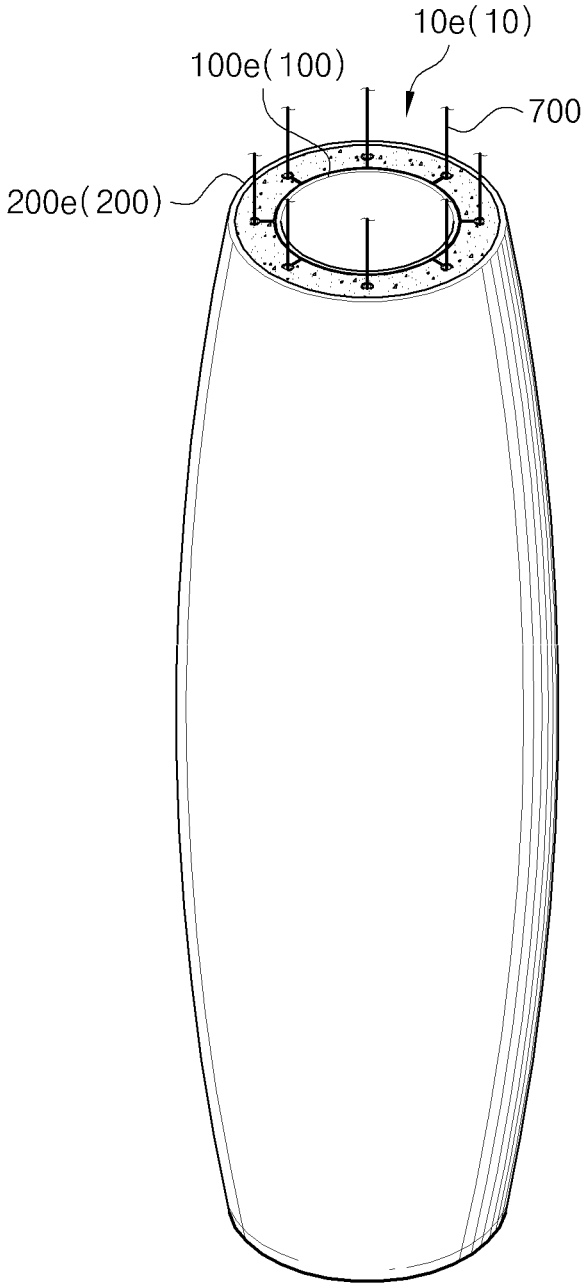
Figure 17:
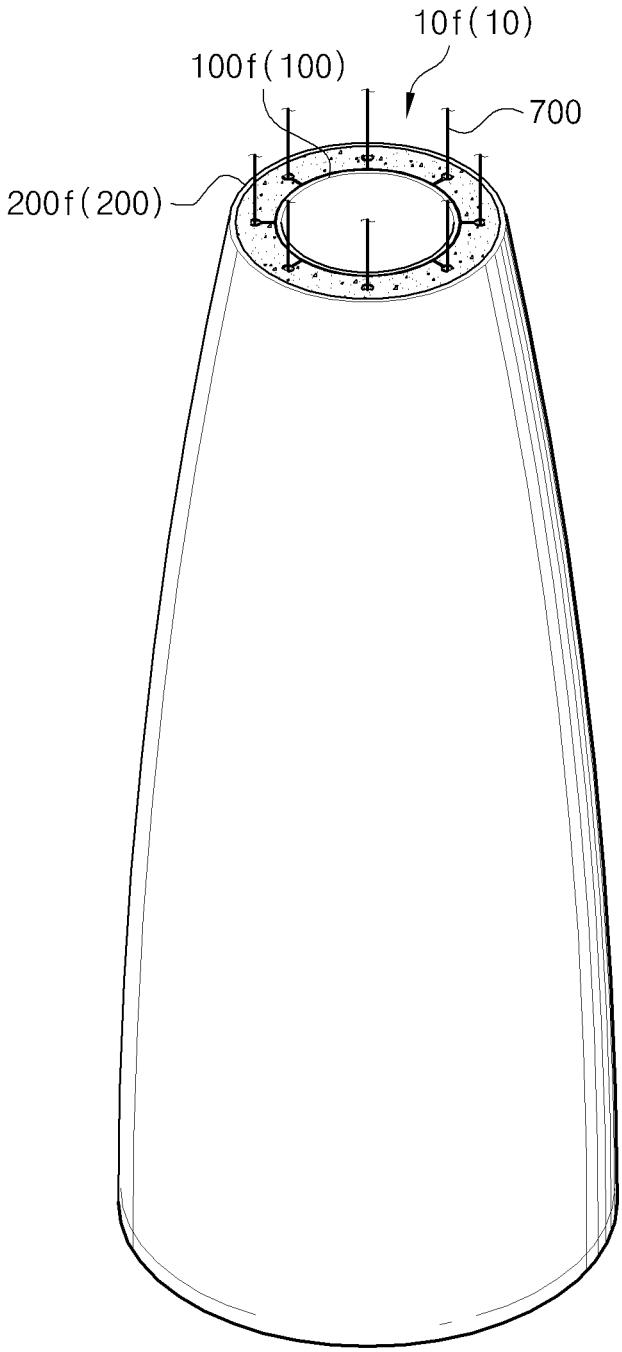

Meanwhile, it has been illustrated in FIGS. 1 to 14 that the inner mold 100 (100*a*, 100*b*, 100*c*) and the outer mold 200 (200*a*, 200*b*, 200*c*) have a uniform cross section such that the filling member 300 (300*a*, 300*c*) is in parallel in a longitudinal direction, but this hollow-core structure is merely an example. The hollow-core structure may be structurally modified in various manners when necessary. FIGS. 15 to 17 illustrate modification examples of the hollow-core structure 10 (10*a*, 10*b*, 10*c*).

As illustrated in FIG. 15, an inner mold 100*d* and an outer mold 200*d* of a hollow-core structure 10*d* may be arranged so that the thickness of the filling member is linearly increased in the longitudinal direction. As illustrated in FIGS. 16 and 17, an inner mold 100*e* or 100*f* and an outer mold 200*e* or 200*f* of a hollow-core structure 10*e* or 10*f* may be arranged so that the thickness of the filling member varies curvelinearly in the longitudinal direction. Here, the inner mold 100*e* and the outer mold 200*e* may be arranged so that the thickness of the filling member is in its maximum at the central portion in the longitudinal direction as illustrated in FIG. 16. Alternatively, the inner mold and the outer mold may be arranged so that the thickness of the filling member increases toward a lower side in the longitudinal direction as illustrated in FIG. 17.

Although the present invention has been described in conjunction with the embodiments illustrated in the drawings, the embodiments are merely examples. It should be understood to those skilled in the art that various modifications and other equivalent embodiments to the embodiments are possible. Therefore, the technical scope of the present invention should be determined by the technical spirit of the appended claims.

The present invention can be used as a structure or a structural component for buildings, towers, piers, and so on.

The invention claimed is:

1. A hollow-core structure comprising:

a plurality of individual inner mold segments that have a hollow cylindrical shell shape;

a plurality of individual outer mold segments that have a hollow cylindrical shell shape to correspond to the plurality of individual inner mold segments, and in which the inner mold segments are disposed to be separated; and a filling member that is filled in a separation space between the inner mold and the outer mold, wherein the filling member being layered and a plurality of individual filling members being coupled to each other, the filling member further includes a plurality of non-shrink high-strength mortar layers that are filled between individual filling members, in which stresses on contact surfaces between the individual filling members are evenly distributed, and wherein the filling member further includes shear keys that are interposed at ends of the individual filling members to reinforce a coupling between the individual filling members.

2. The hollow-core structure of claim 1, further comprising:

a plurality of individual confinement units that respectively surround outer peripheral surfaces of individual outer mold segments to independently confine the individual outer mold segments.

3. The hollow-core structure of claim 2, wherein the plurality of individual confinement units are made of a carbon fiber reinforced polymer (CFRP) material that is wound around the outer peripheral surfaces of the individual outer mold segments by a plurality of turns.

4. The hollow-core structure of claim 1, further comprising:

a plurality of individual ducts units that is arranged along the circumference of the inner molds and between the individual inner mold segments and the individual outer mold segments; and a plurality of prestressing tendons that is inserted through the duct units and is tensioned.

5. The hollow-core structure of claim 4, further comprising:

individual duct fixing units are attached to the outer peripheral surface of the individual inner mold segments, and are provided with a plurality of holders capable of detachably holding the individual duct units.

6. The hollow-core structure of claim 1, wherein the individual inner mold segments and the individual outer mold segments are divided to be layered and are vertically adjacent to each other are coupled in a female and male coupling manner.

7. The hollow-core structure of claim 1, wherein the individual inner mold segments and the individual outer mold segments are divided to be layered and are vertically adjacent to each other are screwed, or are slidably coupled.

8. The hollow-core structure of claim 1, wherein the filling member includes a plurality of individual filling member segments which correspond to the individual inner mold segments and the individual outer mold segments.

9. The hollow-core structure of claim 1, wherein the individual inner mold segments and the individual outer mold segments are formed by molding a plastic material, wherein the filling member is concrete.

10. The hollow-core structure of claim 9, wherein reinforcement steel or a reinforcing material including reinforcing fiber is embedded into the concrete.

11. The hollow-core structure of claim 1, wherein the individual inner mold segments and the individual outer mold segments have a respective constant diameter all the way through the longitudinal direction.

12. The hollow-core structure of claim 1, wherein diameters of the individual inner mold segments and the individual outer mold segments linearly increase respectively toward the lower end of the structure in the longitudinal direction to form a tapered overall elevation.

13. The hollow-core structure of claim 1, wherein diameters of the individual inner mold segments and the individual outer mold segments symmetrically increase and decrease respectively toward the mid height of the structure in the longitudinal direction.

* * * * *